US009157585B2

(12) United States Patent
Weber et al.

(10) Patent No.: US 9,157,585 B2
(45) Date of Patent: Oct. 13, 2015

(54) AREA LIGHT

(71) Applicant: Milwaukee Electric Tool Corporation, Brookfield, WI (US)

(72) Inventors: Andrew J. Weber, Cudahy, WI (US); Justin D. Dorman, Wauwatosa, WI (US); Timothy Janda, Kenosha, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 88 days.

(21) Appl. No.: 14/011,032

(22) Filed: Aug. 27, 2013

(65) Prior Publication Data

US 2014/0043800 A1 Feb. 13, 2014

Related U.S. Application Data

(63) Continuation-in-part of application No. 13/842,737, filed on Mar. 15, 2013.

(60) Provisional application No. 61/616,821, filed on Mar. 28, 2012.

(51) Int. Cl.

| | |
|---|---|
| ***F21L 4/00*** | (2006.01) |
| ***F21S 6/00*** | (2006.01) |
| ***F21S 9/02*** | (2006.01) |
| ***F21V 21/06*** | (2006.01) |
| ***F21V 21/14*** | (2006.01) |
| ***F21V 21/30*** | (2006.01) |
| ***F21V 21/40*** | (2006.01) |
| ***F21V 29/76*** | (2015.01) |
| *F21V 21/088* | (2006.01) |
| *F21V 7/00* | (2006.01) |
| *F21V 13/04* | (2006.01) |
| *F21V 15/015* | (2006.01) |
| *F21V 21/08* | (2006.01) |
| *F21W 131/10* | (2006.01) |

(Continued)

(52) U.S. Cl.

CPC . *F21L 4/00* (2013.01); *F21S 6/004* (2013.01); *F21S 9/02* (2013.01); *F21V 21/06* (2013.01); *F21V 21/14* (2013.01); *F21V 21/30* (2013.01); *F21V 21/40* (2013.01); *F21V 29/767* (2015.01); *F21V 7/0083* (2013.01); *F21V 13/04* (2013.01); *F21V 15/015* (2013.01); *F21V 21/08* (2013.01); *F21V 21/088* (2013.01); *F21W 2131/1005* (2013.01); *F21Y 2101/02* (2013.01); *F21Y 2105/001* (2013.01)

(58) Field of Classification Search

USPC ..... 362/183, 184, 294, 373, 362

See application file for complete search history.

(56) References Cited

U.S. PATENT DOCUMENTS

| | | | |
|---|---|---|---|
| 3,331,958 | A | 7/1967 | Adler |
| 4,268,894 | A | 5/1981 | Bartunek et al. |

(Continued)

*Primary Examiner* — Peggy Neils

(74) *Attorney, Agent, or Firm* — Michael Best & Friedrich LLP

(57) ABSTRACT

A work light includes a housing including a first end portion, a second end portion opposite the first end portion, and a center portion extending between the first end portion and the second end portion. A battery receptacle is located on the housing and is configured to receive a power tool battery pack having a voltage of at least 18 volts. An LED light source is supported by the housing and is powered by the power tool battery pack and a reflector is positioned adjacent the LED light source and arranged to cooperate with the LED light source to produce light having an intensity at a distance of one meter that is at least 1200 Lux.

23 Claims, 14 Drawing Sheets

(51) Int. Cl.
*F21Y 101/02* (2006.01)
*F21Y 105/00* (2006.01)

(56) References Cited

U.S. PATENT DOCUMENTS

| | | | | |
|---|---|---|---|---|
| 6,149,283 | A | 11/2000 | Conway et al. | |
| 6,367,949 | B1 * | 4/2002 | Pederson | 362/240 |
| 6,461,017 | B2 | 10/2002 | Selkee | |
| 6,857,756 | B2 | 2/2005 | Reiff et al. | |
| 7,001,047 | B2 | 2/2006 | Holder et al. | |
| 7,153,004 | B2 | 12/2006 | Galli | |
| 7,278,761 | B2 | 10/2007 | Kuan | |
| 7,367,695 | B2 | 5/2008 | Shiau | |
| 7,470,036 | B2 | 12/2008 | Deighton et al. | |
| 7,618,154 | B2 | 11/2009 | Rosiello | |
| 7,638,970 | B1 | 12/2009 | Gebhard et al. | |
| 7,670,034 | B2 | 3/2010 | Zhang et al. | |
| 7,857,486 | B2 | 12/2010 | Long et al. | |
| 7,914,178 | B2 | 3/2011 | Xiang et al. | |
| 7,914,182 | B2 | 3/2011 | Mrakovich et al. | |
| 7,988,335 | B2 | 8/2011 | Liu et al. | |
| 7,990,062 | B2 | 8/2011 | Liu | |
| 8,007,128 | B2 | 8/2011 | Wu et al. | |
| 8,029,169 | B2 | 10/2011 | Liu | |
| 8,167,466 | B2 | 5/2012 | Liu | |
| 8,235,552 | B1 * | 8/2012 | Tsuge | 362/253 |
| 8,294,340 | B2 | 10/2012 | Yu et al. | |
| 8,322,892 | B2 | 12/2012 | Scordino et al. | |
| 8,330,337 | B2 | 12/2012 | Yu et al. | |
| 8,366,290 | B2 | 2/2013 | Maglica | |
| 8,547,022 | B2 | 10/2013 | Summerford et al. | |
| 2006/0007682 | A1 | 1/2006 | Reiff et al. | |
| 2006/0067077 | A1 * | 3/2006 | Kumthampinij et al. | 362/294 |
| 2006/0285323 | A1 | 12/2006 | Fowler | |
| 2007/0211470 | A1 | 9/2007 | Huang | |
| 2007/0297167 | A1 * | 12/2007 | Greenhoe | 362/183 |
| 2008/0112170 | A1 | 5/2008 | Trott et al. | |
| 2008/0158887 | A1 | 7/2008 | Zhu et al. | |
| 2008/0165537 | A1 | 7/2008 | Shiau | |
| 2008/0198588 | A1 | 8/2008 | O'Hern | |
| 2009/0134191 | A1 | 5/2009 | Phillips | |
| 2009/0135594 | A1 | 5/2009 | Yu et al. | |
| 2010/0027260 | A1 | 2/2010 | Liu | |
| 2010/0027269 | A1 | 2/2010 | Lo et al. | |
| 2010/0072897 | A1 | 3/2010 | Zheng | |
| 2010/0080005 | A1 | 4/2010 | Gattari | |
| 2010/0315824 | A1 | 12/2010 | Chen | |
| 2011/0031887 | A1 | 2/2011 | Stoll et al. | |
| 2011/0038144 | A1 | 2/2011 | Chang | |
| 2011/0050070 | A1 | 3/2011 | Pickard | |
| 2011/0058367 | A1 | 3/2011 | Shiau et al. | |
| 2011/0075404 | A1 * | 3/2011 | Allen et al. | 362/183 |
| 2011/0121727 | A1 | 5/2011 | Sharrah et al. | |
| 2011/0228524 | A1 * | 9/2011 | Greer | 362/190 |
| 2011/0286216 | A1 | 11/2011 | Araman | |
| 2011/0317420 | A1 | 12/2011 | Jeon et al. | |
| 2012/0026729 | A1 | 2/2012 | Sanchez et al. | |
| 2012/0033400 | A1 | 2/2012 | Remus et al. | |
| 2012/0033429 | A1 | 2/2012 | Van Den Ven | |
| 2012/0044707 | A1 | 2/2012 | Breidenassel | |
| 2012/0049717 | A1 | 3/2012 | Lu | |
| 2012/0057351 | A1 | 3/2012 | Wilcox et al. | |
| 2012/0087118 | A1 | 4/2012 | Bailey et al. | |
| 2012/0087125 | A1 | 4/2012 | Liu | |
| 2012/0098437 | A1 | 4/2012 | Smed | |
| 2012/0212963 | A1 | 8/2012 | Jigamian | |
| 2012/0234519 | A1 | 9/2012 | Lee | |
| 2012/0236551 | A1 * | 9/2012 | Sharrah et al. | 362/204 |
| 2012/0247735 | A1 | 10/2012 | Ito et al. | |
| 2012/0262917 | A1 | 10/2012 | Courcelle | |
| 2013/0032323 | A1 | 2/2013 | Hsu | |
| 2013/0077296 | A1 | 3/2013 | Goeckel et al. | |
| 2013/0176713 | A1 * | 7/2013 | Deighton et al. | 362/183 |

* cited by examiner

AREA LIGHT

CROSS-REFERENCE TO RELATED APPLICATIONS

This application is a continuation-in-part application of U.S. patent application Ser. No. 13/842,737, filed Mar. 15, 2013 which claims priority to U.S. Provisional Patent Application No. 61/616,821 filed on Mar. 28, 2012, the entire content of each are incorporated herein by reference.

FIELD OF THE INVENTION

The present invention relates to an area light or kick light. More specifically, the invention relates to an LED-based area light or kick light that is powered by a DC power source and that is easily positionable to provide the desired illumination.

BACKGROUND

Area lights or kick lights are commonly used to illuminate work areas that are otherwise difficult to light. Examples of these areas include work sites, ceiling spaces, basement areas, and the like. The lights are typically positioned such that they shine light in the desired area without being held by a user.

SUMMARY

The invention provides, in one aspect, a work light. The work light includes a housing including a first end portion, a second end portion opposite the first end portion, and a center portion extending between the first end portion and the second end portion. The work light also includes a battery receptacle located on the housing and configured to receive a battery. The work light also includes a light source supported by the housing and a heat sink thermally coupled to the light source. The heat sink includes a contact plate extending through the center portion of the housing and a first leg supported proximate the first end portion. The first leg extends from the contact plate in a direction generally perpendicular to the contact plate. The heat sink also includes a second leg supported proximate the second end portion and extending from the contact plate in a direction generally perpendicular to the contact plate. The heat sink also includes a plurality of fins. Each fin extends from one of the first leg and the second leg.

The invention provides, in another aspect, a work light. The work light includes a housing including a first end portion and a second end portion. The first end portion includes a first plurality of positioning surfaces disposed along a circumferential direction of the first end portion, and the second end portion includes a second plurality of positioning surfaces disposed along a circumferential direction of the second end portion. Each of the first plurality of positioning surfaces is aligned with one of the second plurality of positioning surfaces such that each of the first plurality of positioning surfaces and its corresponding one of the second plurality of positioning surfaces are selectively engageable with a base surface. The work light also includes a light source supported by the housing. The light source includes a plurality of LEDs. The work light also includes a generally U-shaped heat sink located within the housing and thermally coupled with the light source. The heat sink includes a first leg, a second leg opposite the first leg, and a contact plate extending between the first leg and the second leg.

The invention provides, in another aspect, a work light for positioning on a base surface to illuminate a work area. The work light includes a housing, the housing including a first end portion, a second end portion opposite the first end portion, and a center portion extending between the first end portion and the second end portion. The work light also includes a rechargeable power tool battery operable to produce a voltage of at least 18 volts, and a battery receptacle located on the housing. The battery receptacle is configured to receive the rechargeable power tool battery. The work light also includes a light source supported by the housing. The light source includes a plurality of LEDs. The work light also includes a plurality of positioning surfaces disposed in a circumferential direction around at least one of the first end portion and the second end portion. Each of the positioning surfaces is configured to be selectively engageable with the base surface to define an orientation of the light source with respect to the base surface.

In another construction, the invention provides a work light that includes a housing including a first end portion, a second end portion opposite the first end portion, and a center portion extending between the first end portion and the second end portion. A battery receptacle is located on the housing and is configured to receive a power tool battery pack having a voltage of at least 18 volts. An LED light source is supported by the housing and is powered by the power tool battery pack and a reflector is positioned adjacent the LED light source and arranged to cooperate with the LED light source to produce light having an intensity at a distance of one meter that is at least 1200 Lux.

In another construction, the invention provides a work light that includes a housing including a battery receptacle located on the housing and configured to receive a power tool battery pack having a voltage of at least 18 volts. An LED light source is supported by the housing and powered by the battery pack. The LED light source is operable in response to a flow of current from the power tool battery pack to emit light having a color rendering index of at least 80.

In another construction, the invention provides a work light that includes a housing, a battery receptacle located on the housing and configured to receive a power tool battery pack having a voltage of at least 18 volts, and an LED light source including a plurality of individual LEDs supported by the housing and powered by the power tool battery pack. A switch is operable between a low setting and a high setting and a reflector is positioned adjacent the LED light source and arranged to cooperate with the LED light source to produce light having an intensity at a distance of one meter that is at least 1200 Lux when the switch is in the high setting and is at least 600 Lux when the switch is in the low setting.

Other features and aspects of the invention will become apparent by consideration of the following detailed description and accompanying drawings.

Figure 1:
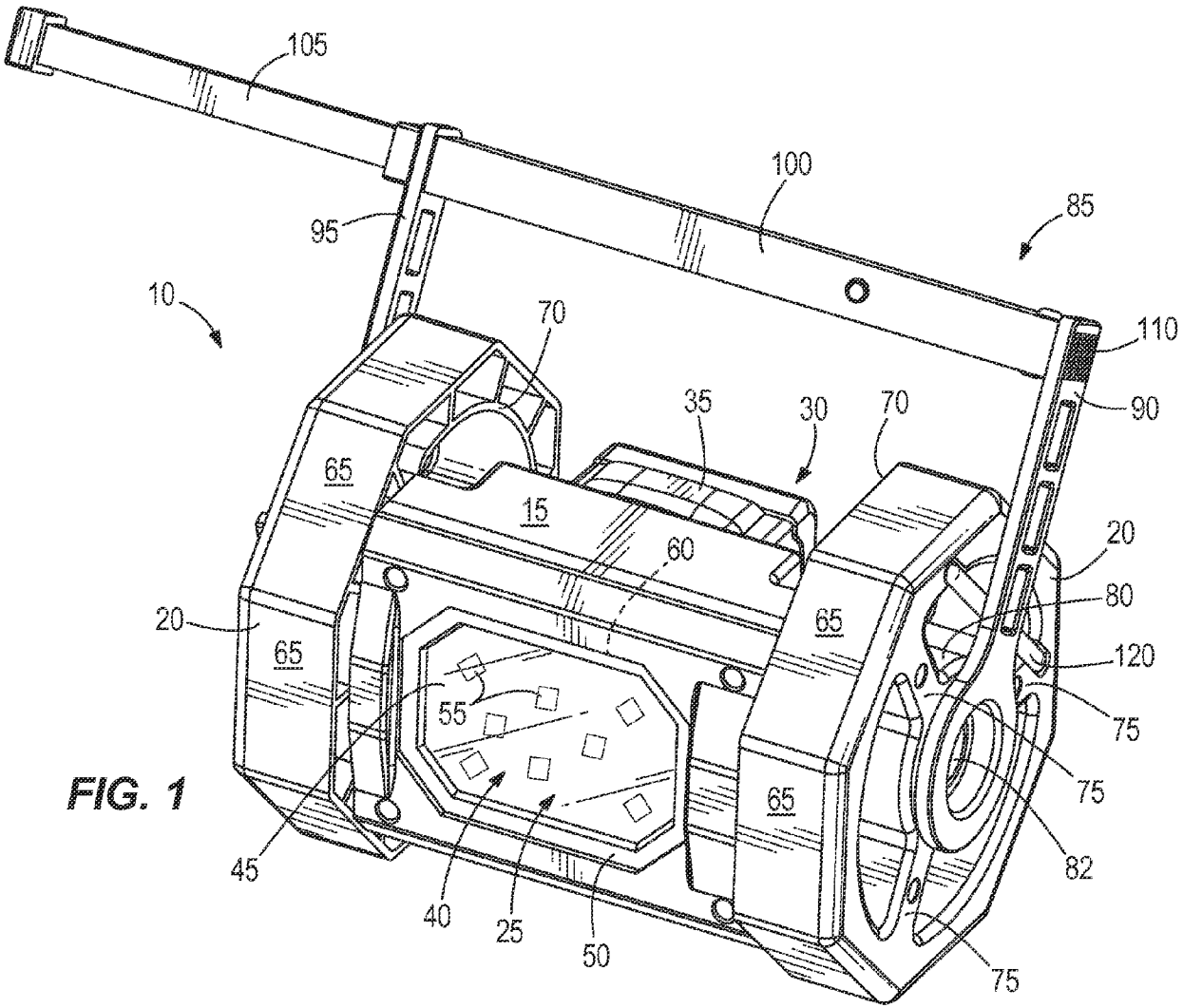
FIG. 1 is a perspective view of an area light according to an embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

FIGS. 1-4 illustrate an area light 10 or kick light according to an embodiment of the invention. The area light 10 includes a housing 15 disposed between two end caps 20. In the illustrated construction, the housing 15 supports a light-emitting portion 25 and a battery portion 30. The battery portion 30 (best illustrated in FIG. 2) is adapted to receive a battery-pack 35, and preferably a battery-pack 35 arranged for use with a power tool. One suitable battery-pack 35 is sold by Milwaukee Electric Tool Corporation as the M18 battery pack 35. The M18 battery pack 35 includes one or more lithium-ion cells arranged to output DC current at about 18 volts. Of course other battery-packs, battery-pack arrangements, or voltages could be employed to power the area light 10 if desired.

With continued reference to FIG. 1, the light-emitting portion 25 is disposed within a substantially planar portion of the housing 15 and includes a light source 40, a reflector 45, and an external lens 50. In the illustrated construction, the light source 40 includes a plurality of light emitting diodes 55 (LEDs) arranged in an array. In the illustrated construction, eight LEDs 55 are arranged in a two-dimensional pattern that provides uniform illumination of a desired area. As one of ordinary skill in the art will realize, the type of light source 40, as well as its arrangement (e.g., the quantity of LEDs 55) could vary greatly as may be required by the application.

The reflector 45 is positioned behind the LEDs 55 and to the side of the LEDs 55 to reflect emitted light toward the lens 50. In one construction, a metallized reflector 45 is used as the reflector 45. The reflector 45 thus improves the total quantity of light that passes through the lens 50 and can diffuse the light as desired. The lens 50 serves to protect the LEDs 55 and other internal components from damage and can function to redirect the emitted light. In the illustrated construction, the lens 50 is slightly diffuse to better spread the light emitted by the LEDs 55. The shape of the lens 50 as well as the wall thickness of the lens 50 can be controlled to further enhance the pattern of light emitted by the lens 50 and the light-emitting portion 25.

The light source 40 is configured to emit a uniform amount of white light. For example, the LEDs 55 are preferably arranged to emit light in a rectangular pattern to uniformly illuminate an area without any brightly lit areas typically referred to as hot-spots. The use of the diffuse lens 50 further reduces the likelihood of hot-spots or bright spots in the illuminated area. The reflector 45 can also be varied to enhance diffusion of the light. In addition to, or in place of the white LEDs 55, other LEDs 55 or light sources 40 could be provided to emit light in other regions of the electromagnetic spectrum (e.g., infrared, ultraviolet, colored visible light, etc.).

The LEDs 55 are connected to a controller 60 that in turn selectively connects or disconnects the LEDs 55 and the battery pack 35. In the illustrated construction, the external lens 50 functions as a button or controller 60 that can be actuated by the user to selectively provide power to the LEDs 55. In other constructions, a separate button, switch, motion sensor, light sensor, or other actuator could be provided to activate and deactivate the LEDs 55.

Figure 2:
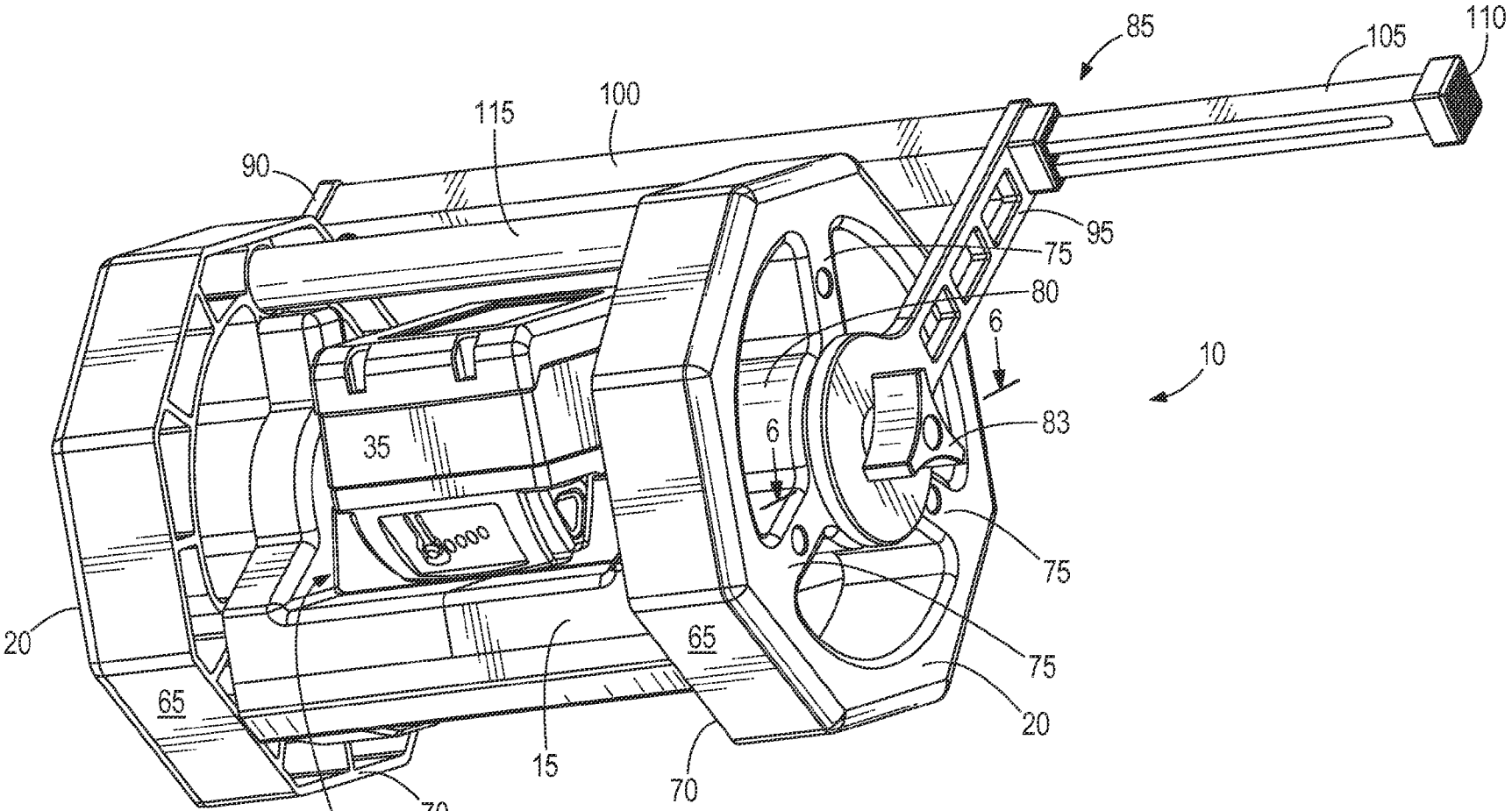
FIG. 2 is another perspective view of the area light of FIG. 1.

As illustrated in FIG. 2, the battery portion 30 is disposed on the opposite side of the housing 15 as the light-emitting portion 25 to assure that the battery 35 does not interfere with the emitted light. In addition, the positioning of the battery portion 30 assures that the housing 15 provides some protection for the battery pack 35. The battery portion 30 includes a receiving port that is adapted to receive the desired battery pack 35 or battery packs 35. As noted above, the illustrated construction includes one battery port that receives a single M18 battery pack 35. However, other constructions could include one or more battery ports adapted to receive the same or different battery packs 35 as may be desired.

Figure 5:
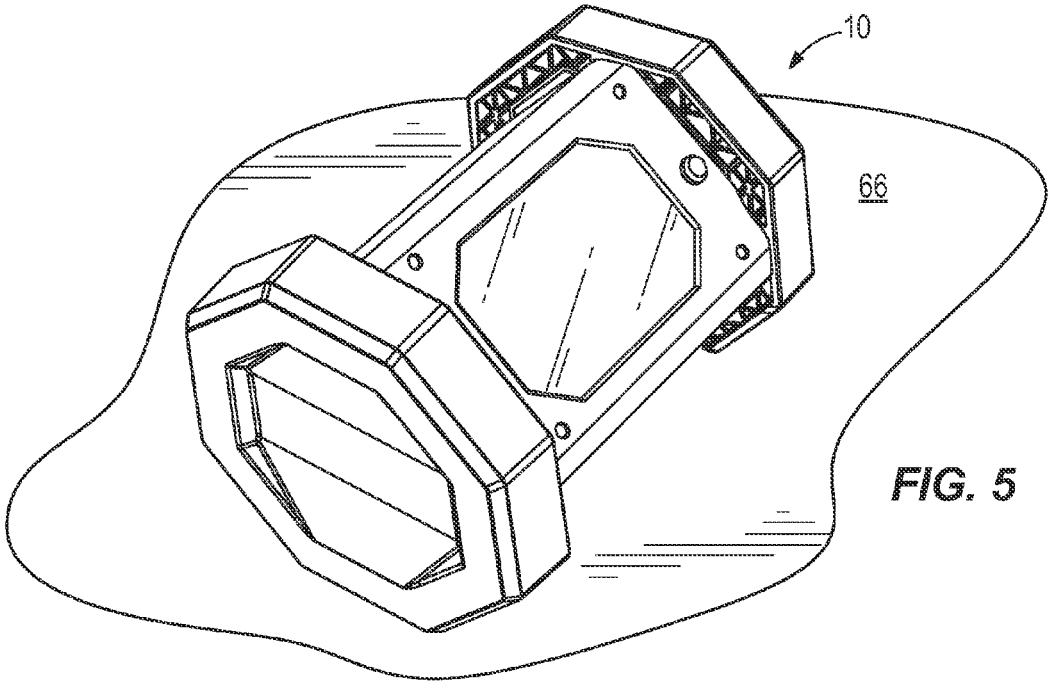
FIG. 5 is a photograph of the area light of FIG. 1 positioned on a surface.

With reference to FIGS. 1 and 2, the end caps 20 include multiple planar exterior surfaces 65 and support the housing 15 between two inner surfaces 70. In the illustrated construction, the end caps 20 include eight substantially planar surfaces 65 that extend around the outer circumference. The exterior surfaces 65 are arranged to allow the emitted light to be directed in a number of directions simply by placing the light 10 on a flat surface 66, as illustrated in FIG. 5. The eight exterior surfaces 65 allow a user to direct the emitted light in one of eight different directions simply by placing the light 10 to rest on the desired exterior surface 65.

FIGS. 1-4 illustrate end caps 20 that each include three radial spokes 75 that connect the exterior surfaces 65 to a central hub 80. The hub 80 includes a hub aperture 82 and is arranged to receive attachments that further enhance the positionability of the light 10. A spring-loaded handle 85 is attached to the hubs 80 of the end caps 20. The spring loaded handle 85 includes a first arm 90 that engages a first of the hubs 80 and a second arm 95 that engages the second hub 80 and threadably engages the second hub 80 to secure the handle 85 to the light 10.

Figure 6:
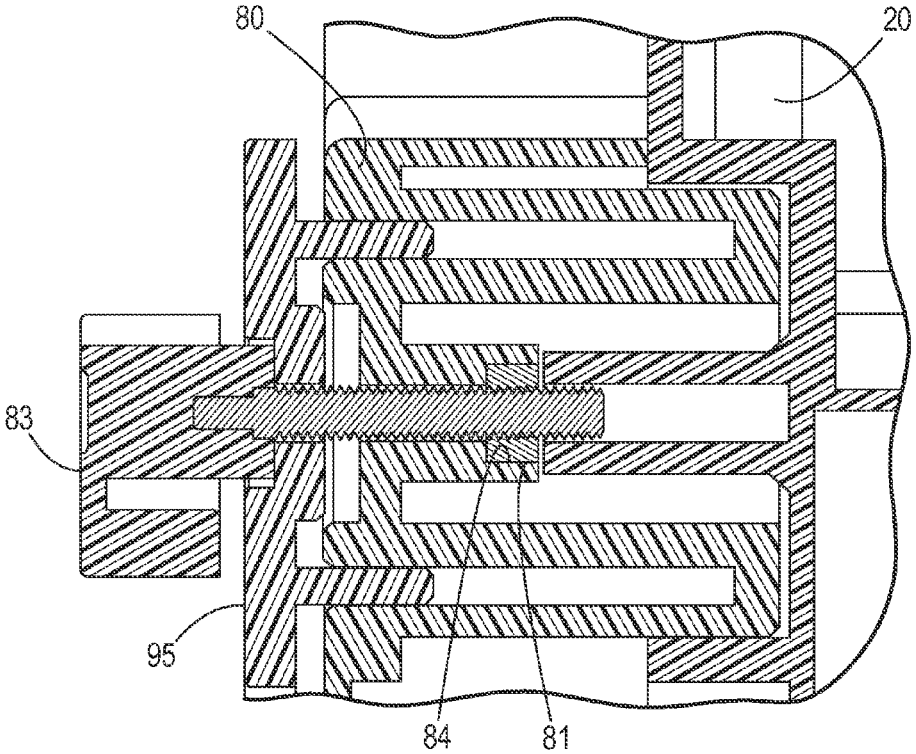
FIG. 6 is a section view taken along line 6-6 of FIG. 2.

As illustrated in FIG. 6 the end cap 20 includes a nut 81 disposed on the interior of the hub 80. The nut is restrained from axial movement by the housing 15 and the end cap 20 and is inhibited from rotation by a hex-shaped receiving space 84 surrounding the nut 81. A threaded knob 83, threadably engages the nut 81 to attach the handle 85 to the light 10.

With reference to FIG. 2, the second arm 95 is sandwiched between the knob 83 and the end cap 20 such that a user is able to tighten the knob 83 to fix the position of the handle 85 with respect to the light 10. When the handle 85 is fixed with respect to the light 10, it can be braced against a surface to support the light 10 in yet another manner or in a different orientation. Alternatively, the second arm 95 includes an adjustment member that allows a user to adjust (threadably or otherwise) the spacing between the arms 90, 95 to clamp the light 10, thereby attaching the handle 85.

The arms 90, 95 extend radially outward beyond the outer diameter of the end caps 20 and support a substantially hollow cross member 100. A telescoping arm 105 is positioned within the hollow cross member 100 and is biased in an outward direction. In preferred arrangements, a coil spring is positioned within the cross member 100 to bias the telescoping arm 105. The exposed end of the telescoping arm 105, along with the outer surface of the first arm 90, includes a roughened surface 110 that serves to enhance the grip of the telescoping arm 105. In addition, the cross member 100 is usable as a handle to carry the light 10 if desired. In some constructions, an enhanced grip portion is formed on the exterior of the cross member 100 to facilitate carrying the light 10. The arms 90, 95 and cross member 100 attach in a manner that allows the orientation of the light 10 with respect to the arms 90, 95 to change as desired, thereby allowing the light 10 to be moved to any orientation around the axis between the hubs 80.

Figure 3:
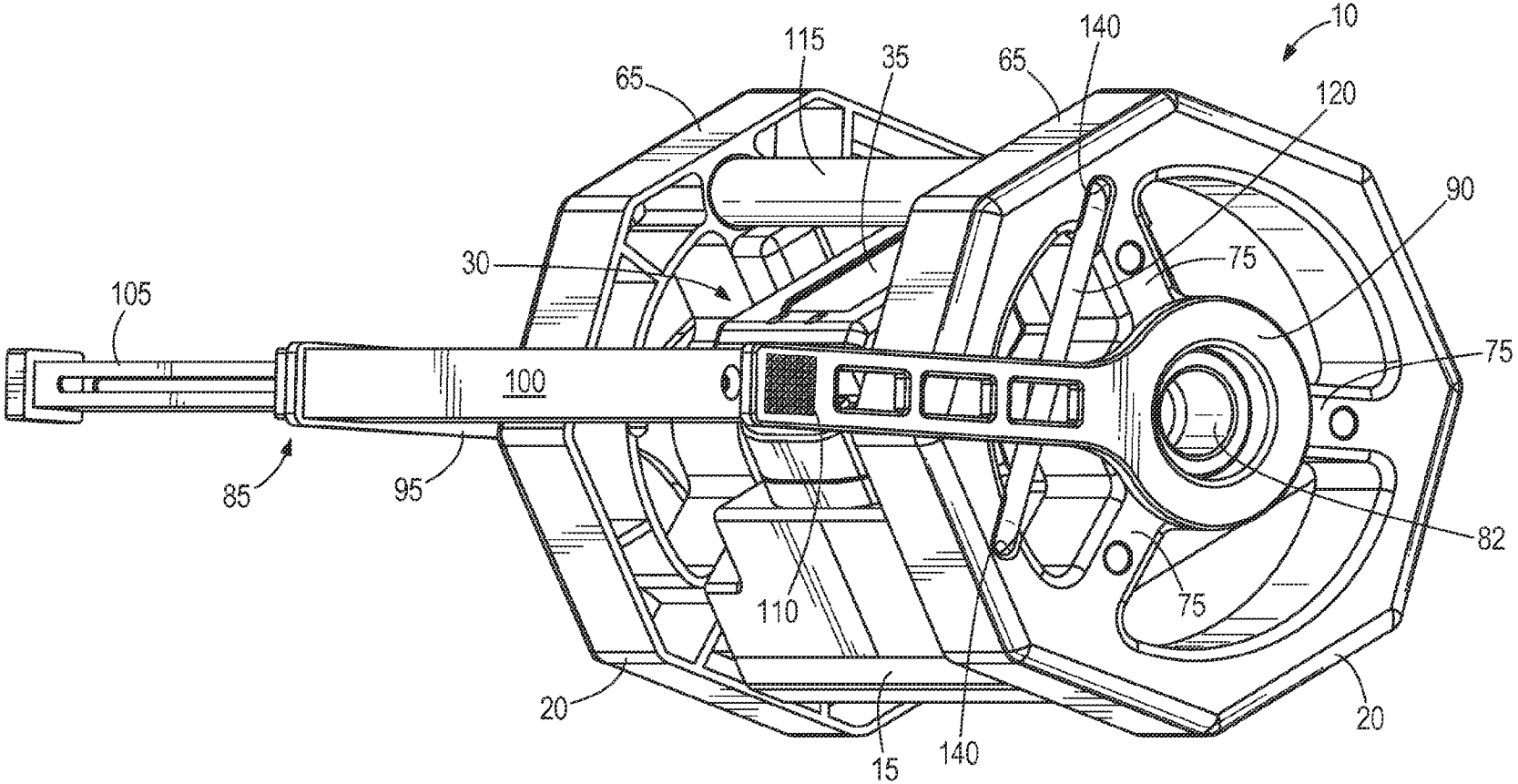
FIG. 3 is another perspective view of the area light of FIG. 1.
Figure 4:
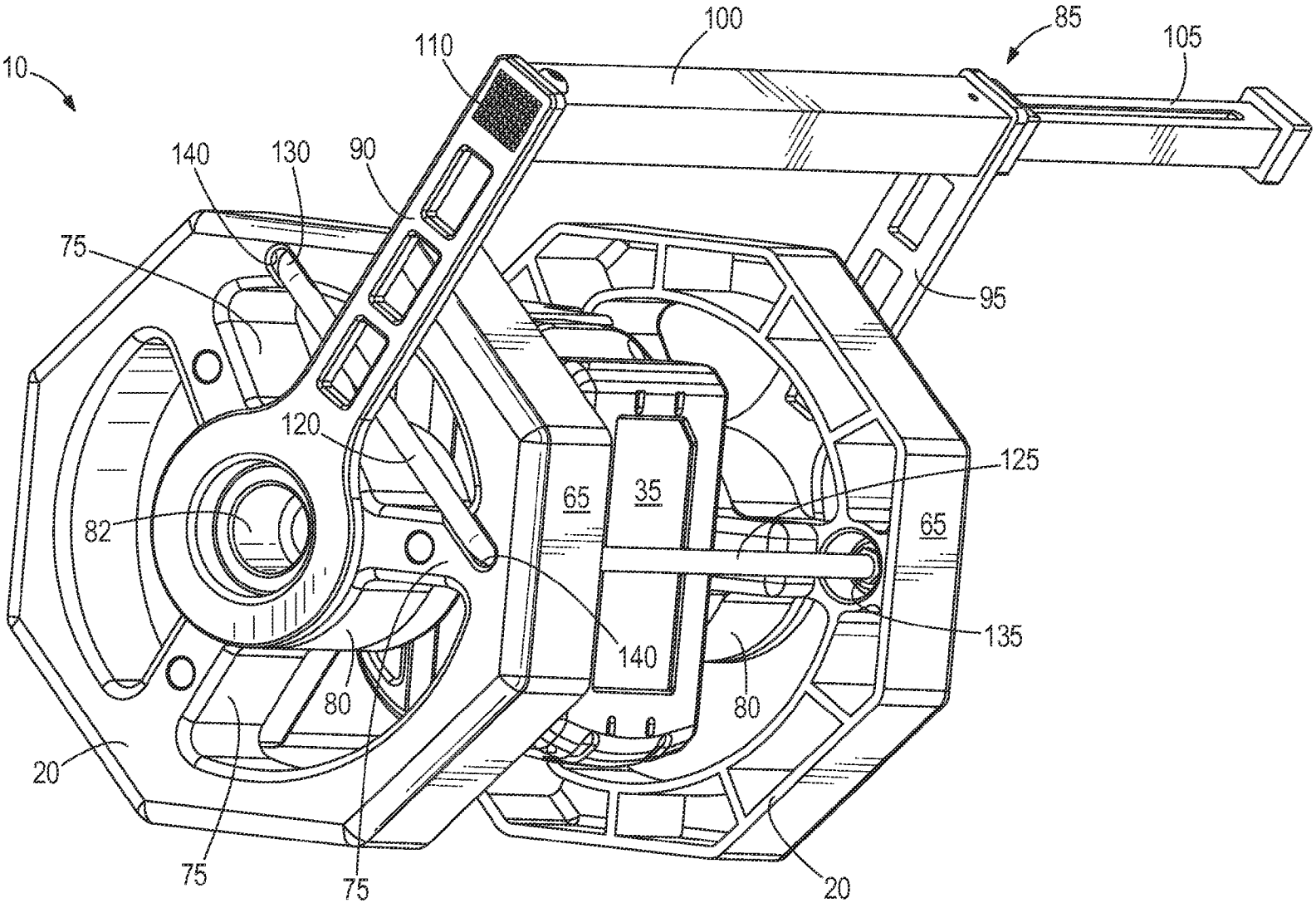
FIG. 4 is another perspective view of the area light of FIG. 1.

FIGS. 3 and 4 illustrate two additional features that can be used to position the light 10 as desired. A cylindrical bar 115, illustrated in FIG. 3 extends between the end caps 20 and can be used as a handle to carry the light 10. In addition, rope, wire, or other similar items can be wrapped or tied to the bar 115 to hang the light 10 if desired. The bar 115 is preferably hollow to reduce the weight of the light 10 and to allow for the passage of a portion of a hook 120.

Figure 7:
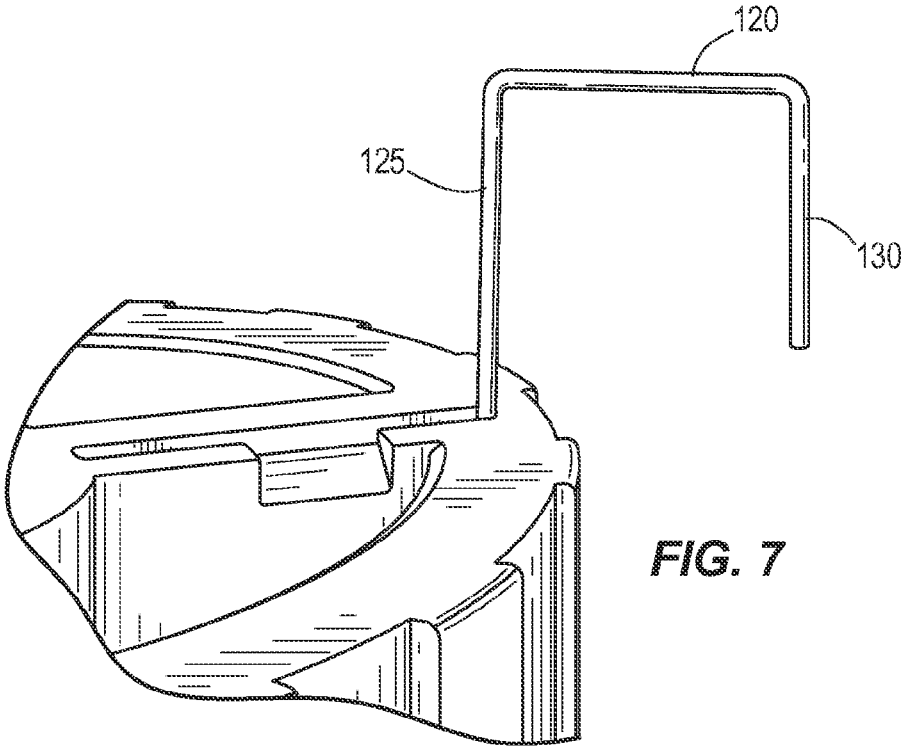
FIG. 7 is a photograph of the area light of FIG. 1, illustrating a hook member.

The hook 120, best illustrated in FIG. 4 includes a long leg 125 and a short leg 130. The long leg 125 is disposed within the bar 115 and includes a nut 135 at its end that serves to trap the hook 120 within the end cap 20 when fully extended. The short leg 130 of the hook 120 is shorter and is received in a hook receiving groove 140 formed in the end cap 20. The hook receiving groove 140 assures that the hook 120 is slightly recessed within the end cap 20 when it is in a stowed position. When the hook 120 is extended, as illustrated in FIG. 7, it can be used to hang the light 10 from any number of objects and in any number of orientations.

Figure 8:
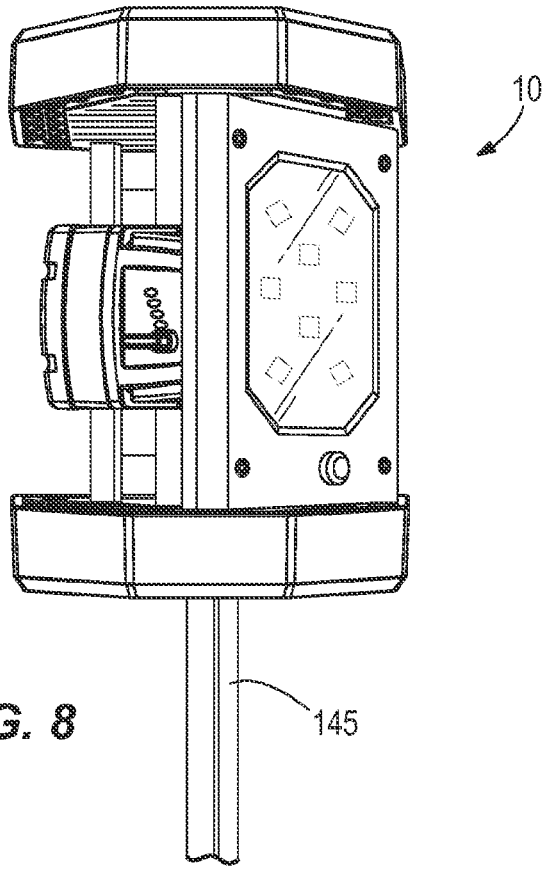
FIG. 8 is a photograph of the area light of FIG. 1, positioned on a post.

In addition to supporting the spring-loaded handle 85, the hub apertures 82 are also sized to receive a tube or pipe 145 as illustrated in FIG. 8. In one construction, the aperture 82 is sized to receive a one-inch conduit or pipe 145 to support the light 10 above a surface using the pipe 145 as a stand. In this arrangement, the light 10 can be rotated to any orientation around the axis of the pipe 145.

Figure 9:
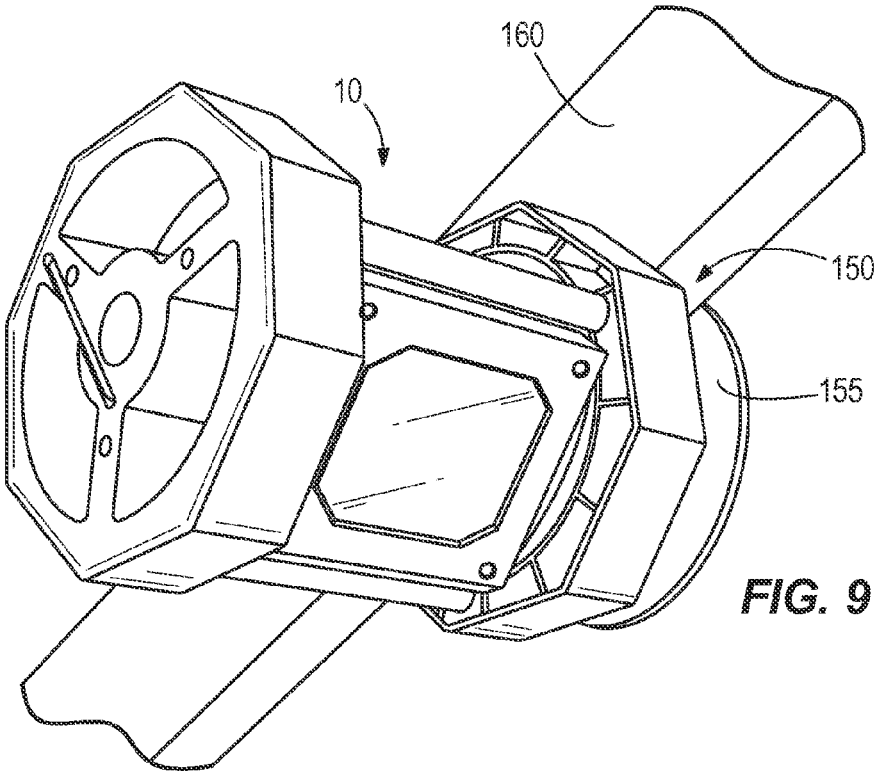
FIG. 9 is a photograph of the area light of FIG. 1, including a clamp for use in supporting the light on a beam or stud.

With reference to FIG. 9, another construction of the area light 10 includes an attachment member 150 that can be coupled to the light 10 to support the light 10 as may be desired. The attachment member 150 includes an external disk 155 that is attached to an engagement member (not shown). The engagement member attaches to the end cap 20 such that the light 10 is rotatable with respect to the engagement member but does not move axially with respect to the engagement member. The external disk 155 is coupled to the engagement member such that it is movable axially. A biasing member biases the external disk 155 toward the engagement member. Thus, the external disk 155 can be pulled away from the light 10 to clamp to an object such as the stud 160 illustrated in FIG. 9. The biasing member produces sufficient force to clamp and hold the light 10 in a cantilever fashion as illustrated in FIG. 9.

Figure 10:
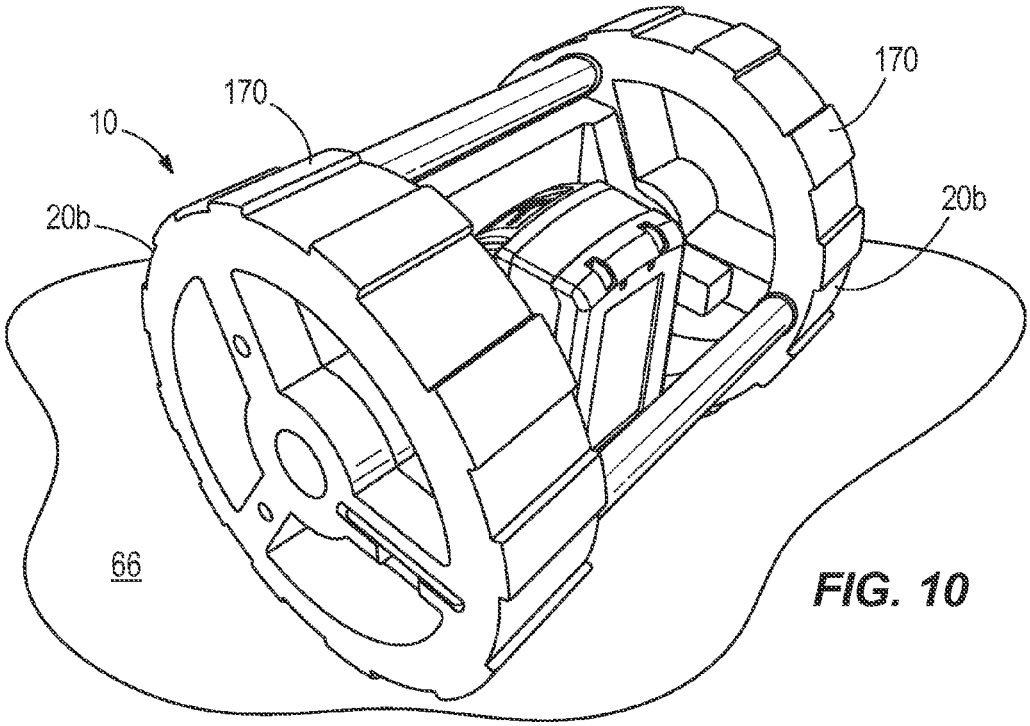
FIG. 10 is a photograph of another area light positioned on a surface.

FIG. 10 illustrates yet another arrangement of the end caps 20*b* that could be used with the light 10. The end caps 20*b* of FIG. 10 do not include external planar surfaces 65 like the end caps 20, but rather include a plurality of protrusions 170. When the end caps 20*b* are placed on the flat surface 66, two adjacent protrusions 170 contact the surface and support the light 10 in the desired orientation. As one of ordinary skill in the art will realize upon review of the present invention, there are many different ways to form the end caps 20 to support the light 10 in multiple orientations.

FIGS. 11-14 illustrate an area light 210 according to another embodiment of the invention. The area light 210 includes many of the same features and characteristics of the area light 10 described above with reference to FIGS. 1-10, and reference should be given to the above description of the area light 10 for additional features and alternatives of the area light 210. In addition, components or features described with respect to only one or some of the embodiments described herein are equally applicable to any other embodiments described herein.

Figure 11:
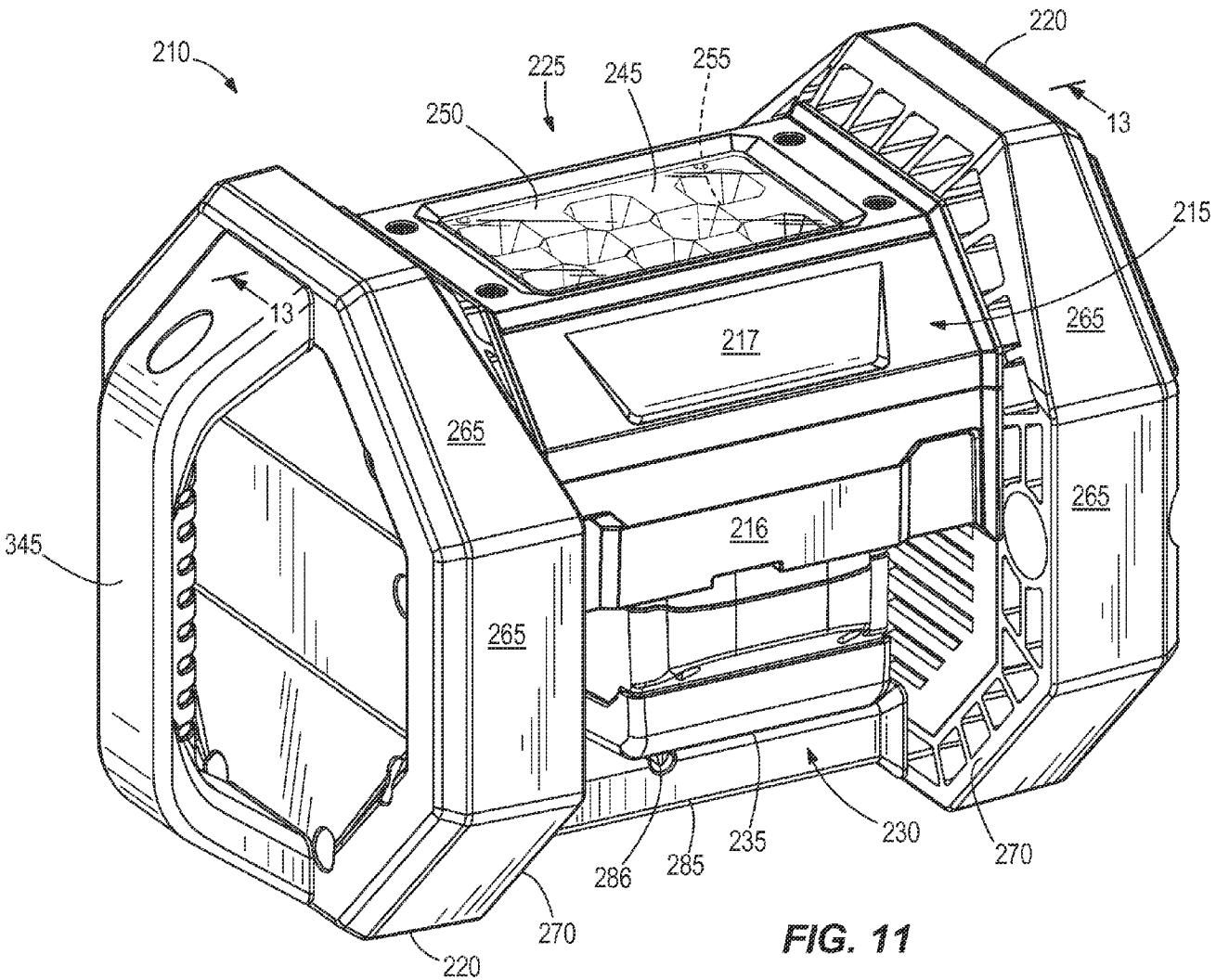
FIG. 11 is a perspective view of an area light according to another embodiment of the invention.
Figure 12:
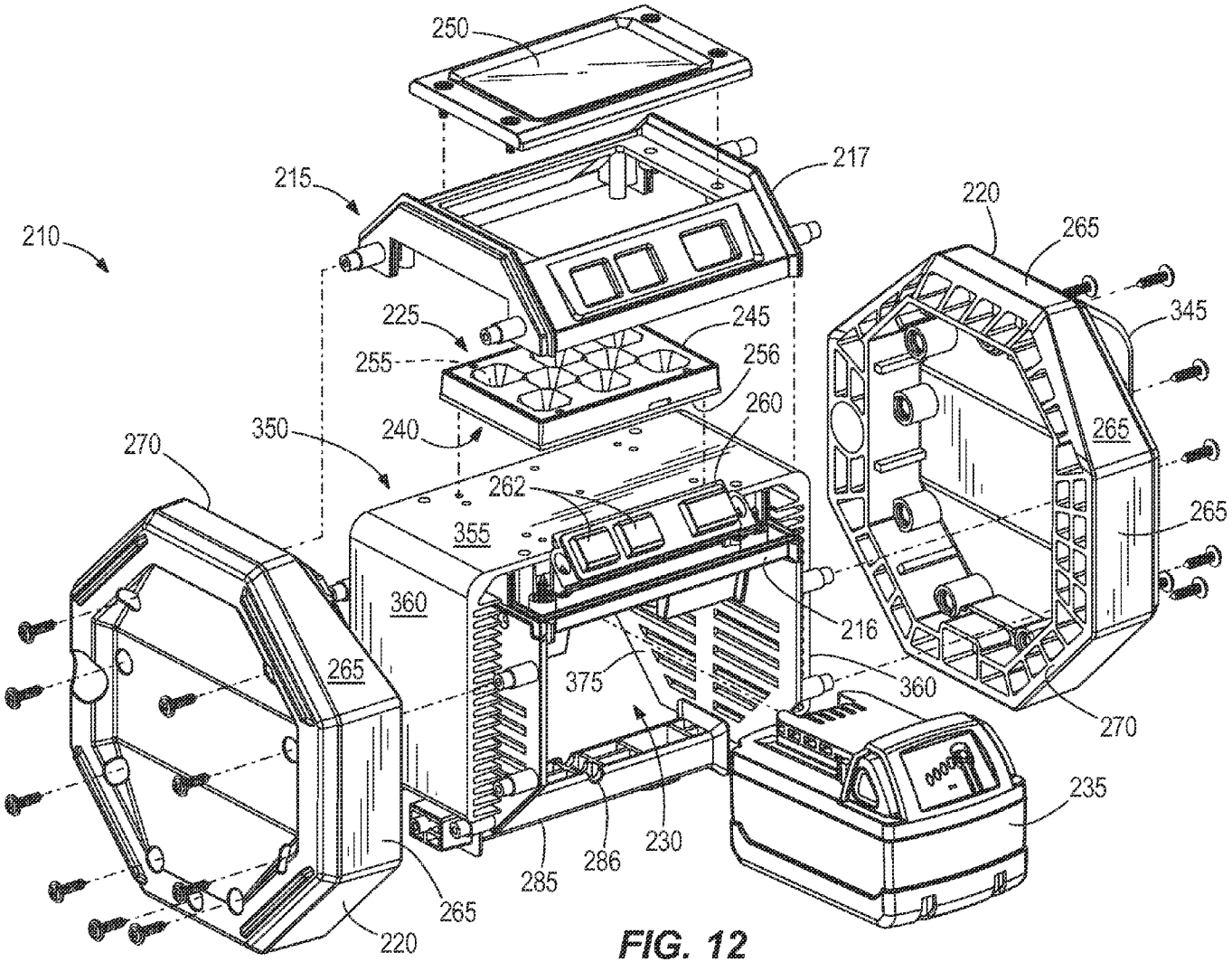
FIG. 12 is an exploded view of the area light of FIG. 11.

With reference to FIGS. 11 and 12, the area light 210 includes a housing 215 extending between two end caps 220. The housing 215 includes a lower housing 216 and an upper housing 217 coupled to the lower housing 216. The upper housing 217 is preferably formed from a rigid, polymeric material by an injection molding process, and the lower housing 216 is preferably formed from die cast metal. Of course, in other constructions the upper housing 217 and the lower housing 216 can be formed from other suitable materials and/or other methods. Alternatively, the housing 215 can be integrally formed as a single piece.

In the illustrated construction, the housing 215 supports a light-emitting portion 225 and a battery portion 230. The battery portion 230 (best illustrated in FIG. 12) is disposed on the lower housing 216 and is adapted to receive a battery-pack 235, and preferably a battery-pack 235 arranged for use with a power tool, such as an M18 battery pack 235 sold by Milwaukee Electric Tool Corporation. The M18 battery pack 235 includes one or more lithium-ion cells arranged to output DC current at about 18 volts. Of course other battery-packs, battery-pack arrangements, or voltages (e.g., 12 volts, 24 volts, etc.) could be employed to power the area light 210 if desired.

Figure 13:
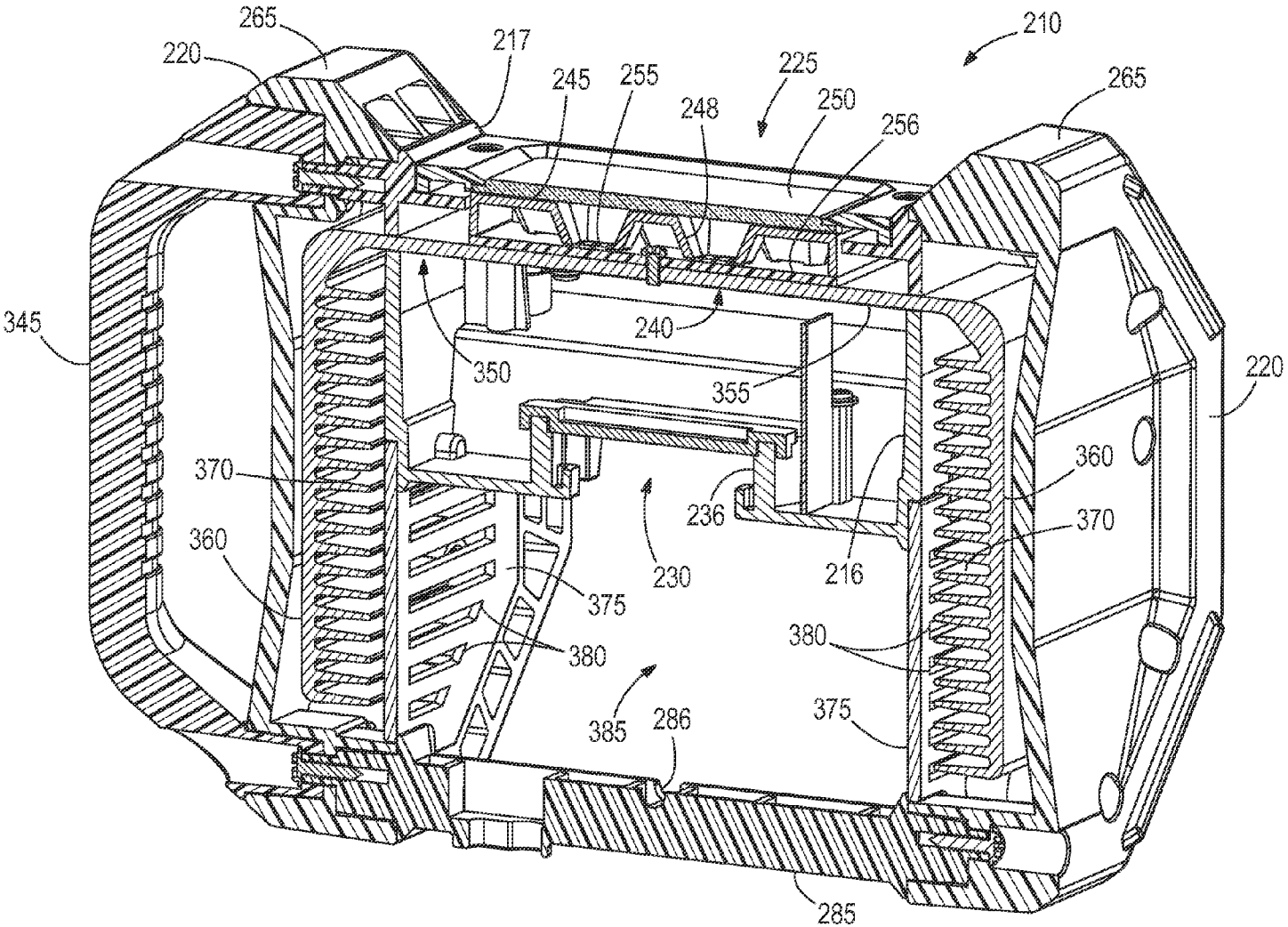
FIG. 13 is a cross-sectional view of the area light of FIG. 11, taken through line 13-13 of FIG. 11.

As illustrated in FIG. 13, the battery portion 230 is disposed on the opposite side of the housing 215 as the light-emitting portion 225 to assure that the battery 235 does not interfere with the emitted light. In addition, the positioning of the battery portion 230 assures that the housing 215 provides some protection for the battery pack 235. The battery portion 230 includes a receptacle or receiving port 236 that is adapted to receive the desired battery pack 235 or battery packs 235. As noted above, the illustrated construction includes one battery port 236 that receives a single M18 battery pack 235. However, other constructions could include one or more battery ports 236 adapted to receive the same or different battery packs 235 as may be desired.

With reference to FIG. 12, the light-emitting portion 225 is disposed within the upper housing 216 and includes a light source 240, a reflector 245, and an external lens 250. In the illustrated construction, the light source 240 includes a plurality of light emitting diodes 255 (LEDs) arranged in an array (best shown in FIG. 14). In the illustrated construction, eight LEDs 255 are arranged in a two-dimensional pattern that provides a generally uniform illumination of a desired area. As one of ordinary skill in the art will realize, the quantity of LEDs 255 as well as their arrangement could vary greatly as may be required by the application.

The reflector 245 includes a plurality of generally conical or pyramidal recesses 248, each positioned about one of the LEDs 255 to reflect emitted light toward the lens 250. In one construction, a metallized reflector 245 is used as the reflector 245. The reflector 245 thus improves the total quantity of light that passes through the lens 250 and can diffuse the light as desired. The lens 250 serves to protect the LEDs 255 and other internal components from damage and can function to redirect the emitted light. In the illustrated construction, the lens 250 is slightly diffuse to better spread the light emitted by the LEDs 255. The shape of the lens 250 as well as the wall thickness of the lens 250 can be controlled to further enhance the pattern of light emitted by the lens 250 and the light-emitting portion 225.

The LEDs 255 are preferably configured to emit a uniform amount of white light. For example, the LEDs 255 are preferably arranged to emit light in a rectangular pattern to uniformly illuminate an area without any brightly lit areas typically referred to as hot-spots. The use of the diffuse lens 250 further reduces the likelihood of hot-spots or bright spots in the illuminated area. The recesses 248 of the reflector 245 also enhance diffusion of the light. In addition to, or in place of the white LEDs 255, other LEDs 255 or light sources 240 could be provided to emit light in other regions of the electromagnetic spectrum (e.g., infrared, ultraviolet, colored visible light, etc.).

Figure 14:
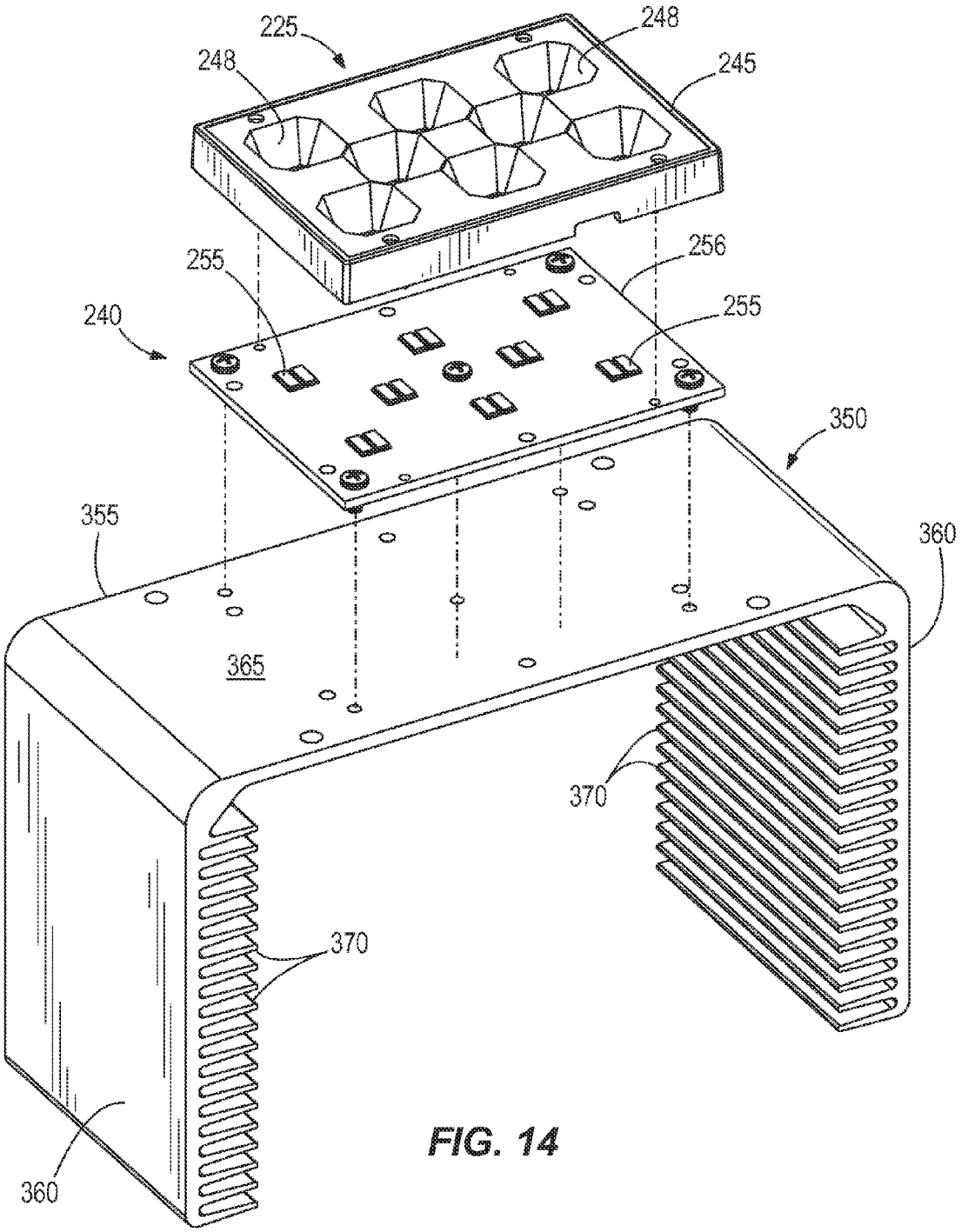
FIG. 14 is an exploded view of a portion of the area light of FIG. 11.

With reference to FIGS. 12 and 14, the LEDs 255 are connected to a circuit board 256, configured to provide an appropriate voltage and current from the battery pack 235 to the LEDs 255 (FIG. 14). The area light 10 includes a controller 260 that in turn selectively connects or disconnects the LEDs 255 from the battery pack 235. In the illustrated construction, the controller 260 includes external buttons 262 that can be actuated by the user to selectively provide power to the LEDs 255 at different levels, (e.g., off, low, and high), each level corresponding to a brightness or intensity of the light emitted by the LEDs 255. In other constructions, a switch, dial, motion sensor, light sensor, or other actuator could be provided to control the LEDs 255. In addition, a dimmer function could be provided and could function to either reduce the power provided to each of the LEDs such that they emit less than 100 percent of their capacity or could actuate only a portion of the available LEDs to vary the total amount of light emitted by the light 10, 210.

With reference to FIG. 11, the end caps 220 include multiple planar exterior surfaces 265 or positioning surfaces 265, and the end caps 220 support the housing 215 between two inner surfaces 270. The end caps 220 are preferably formed from an impact-resistant, polymeric material to provide some protection from falls or impacts to the area light 210. In the illustrated construction, each of the end caps 220 includes eight substantially planar surfaces 265 that extend around the outer circumference, such that the end caps 220 have a generally octagonal shape. The exterior surfaces 265 of the end caps 220 are arranged to allow the emitted light to be directed in a number of directions or orientations, simply by placing the light 210 on a flat, base surface, such as the surface 66 shown in FIGS. 5 and 10. The eight exterior surfaces 265 allow a user to direct the emitted light in one of eight different directions simply by placing the light 210 on the desired exterior surface 265. In other constructions, the end caps 220 can include any other number of exterior surfaces 265 extending around the outer circumference. As one of ordinary skill in the art will realize upon review of the present invention, there are many different ways to form the end caps 220 to support the light 210 in multiple orientations.

In FIGS. 11-13 a cross bar 285 is coupled to the inner surfaces 270 of the end caps 220. The cross bar 285 is usable as a handle to carry the light 210 if desired. In the illustrated construction, the cross bar 285 includes a recess 286 to facilitate suspending the light 210 by a rope, cable or hook, for example. The cross bar 285 also provides some protection to the battery portion 230. An additional handle 345 extends across the diameter of one of the end caps 220. The handle 345 can also be used to carry or hang the light 210.

In the illustrated construction, the LEDs 255 generate heat that must be dissipated in order to provide reliable operation of the area light 210. As illustrated in FIGS. 12-14, the area light 210 includes a generally U-shaped heat sink 350 positioned around the lower housing 216. The heat sink 350 includes a contact plate 355 and two legs 360 extending substantially perpendicularly from the ends of the contact plate 355. In other constructions, the heat sink can have any shape suitable for attachment to the housing 215. In the illustrated construction, the heat sink 350 is formed from a single piece of thermally conductive material, such as aluminum or copper. Alternatively, the heat sink 350 can be formed from multiple pieces coupled together (e.g., by bolting, brazing, welding, etc.).

With reference to FIG. 14, the contact plate 355 includes a substantially planar top surface 365. In the illustrated construction, the circuit board 256 carrying the LEDs 255 is directly coupled to the contact plate 355 to allow the heat generated by the LEDs 255 to be transferred to the contact plate 355. In other constructions, an additional layer of thermally conductive material, such as thermal gel or paste, can be included between the circuit board 256 and the contact plate 355.

Heat transferred from the LEDs 255 to the contact plate 355 is dissipated through the legs 360. The legs 360 each include fins 370 extending inwardly from the legs 360 in a direction generally parallel to the top surface 365 of the contact plate 355. The fins 370 increase the surface area of the legs 360 to provide greater heat transfer between the fins 370 and the surrounding air. As is best illustrated in FIG. 13, the legs 360 and the fins 370 of the heat sink 350 are located within the end caps 220 of the area light 210. This arrangement draws heat away from the center of the housing 215. The end caps 220 each include a vent plate 375 located adjacent the inner surface 270. The vent plates 375 include a plurality of vent openings 380 extending through the vent plates 375. A relatively open air space 385 located between the end caps 220 allows fluid communication between the ambient atmosphere surrounding the area light 210 and the fins 370 to facilitate heat transfer from the fins 370 to the atmosphere. The vent plates 375 also serve to protect the fins 370 and inhibit the user from making direct contact with the fins 370.

Figure 15:
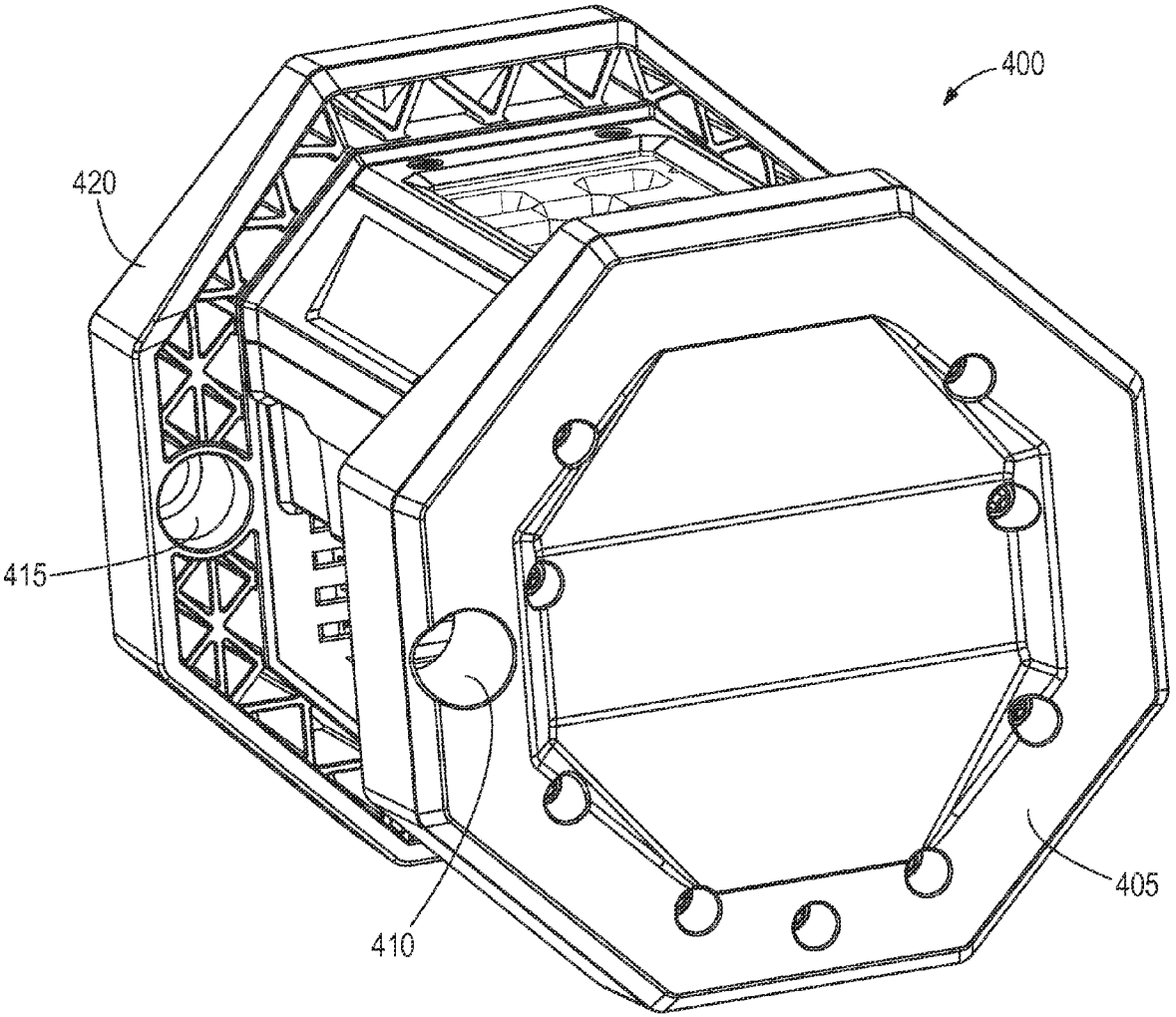
FIG. 15 is a perspective view of another area light illustrating a support feature adaptable to any construction illustrated herein.
Figure 16:
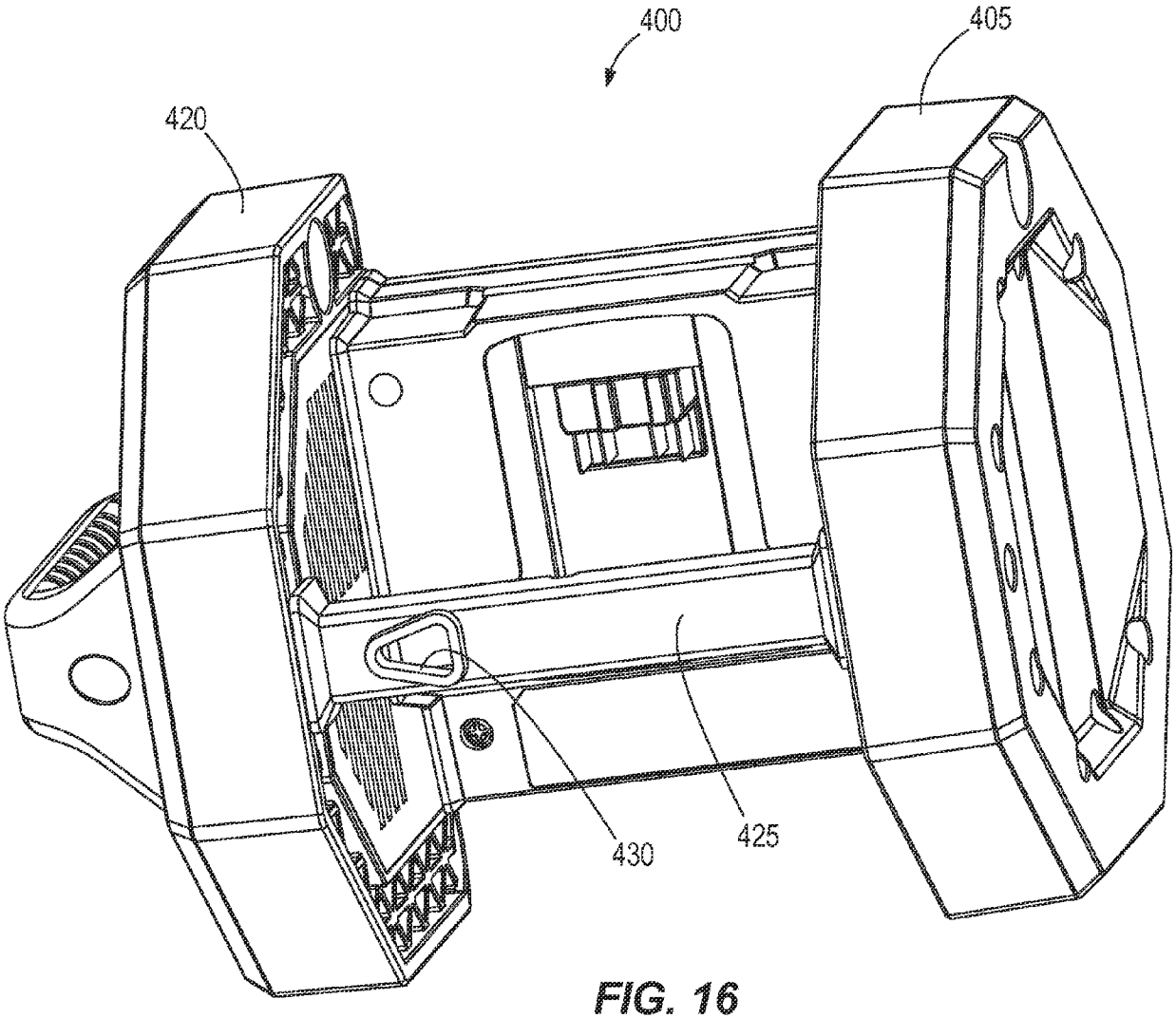
FIG. 16 is a perspective view of the area light of FIG. 15 illustrating another support feature adaptable to any construction illustrated herein.
Figure 17:
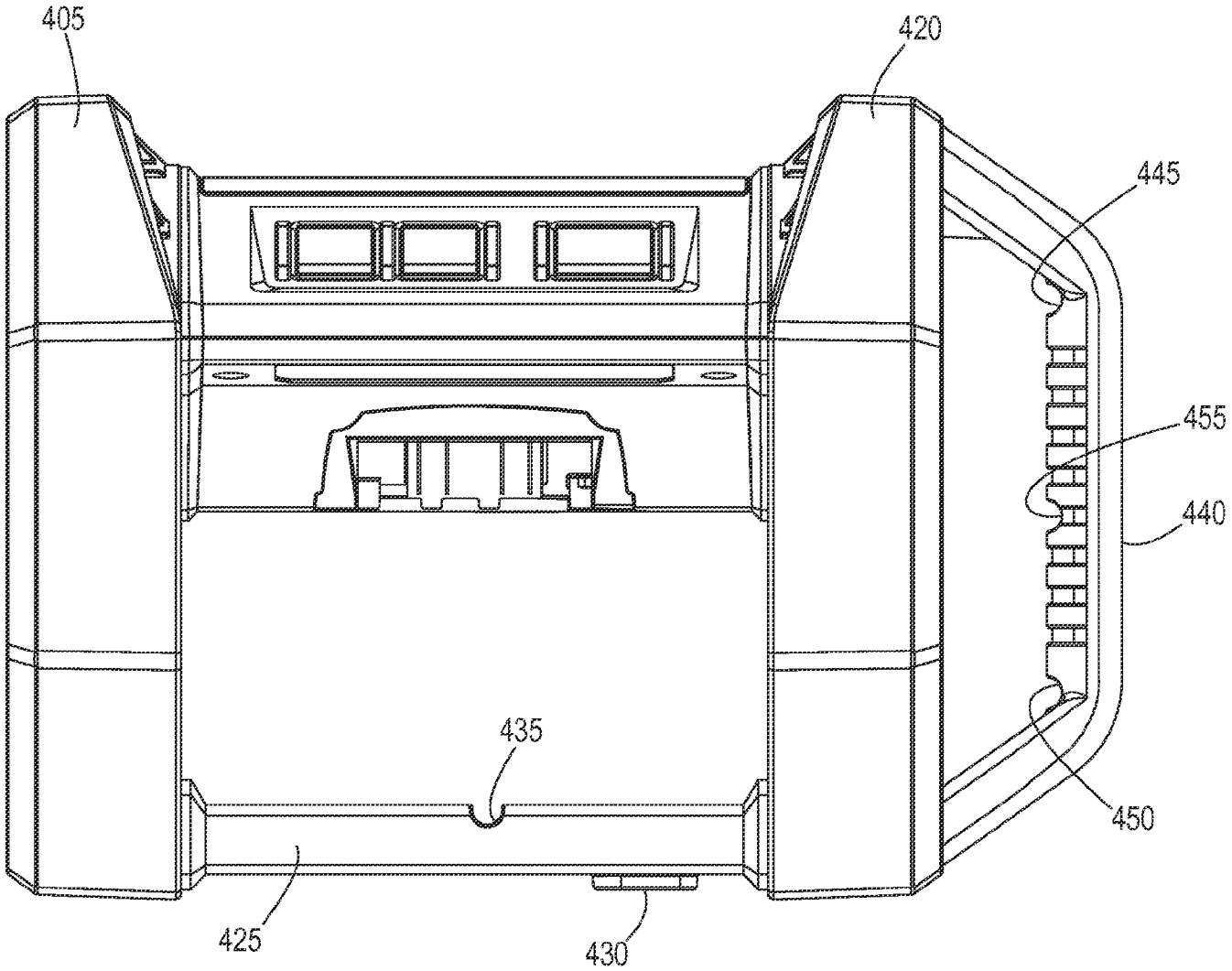
FIG. 17 is a side view of the area light of FIG. 15 including additional support features adaptable to any construction illustrated herein.

FIGS. 15-17 illustrate another area light 400 that includes additional support features that are equally adaptable to the other constructions illustrated herein. FIG. 15 illustrates a first support feature in the form of a first aperture 410 and a second aperture 415. The first aperture 410 extends through an edge of a first end cap 405 along an axis that is parallel to the long axis of the area light. The second aperture 415 extends part of the way through the second end cap 420 along the same axis as the first aperture 410. The second aperture 415 defines a stop surface normal to the axis. To use the apertures, a user inserts a tube or pipe through the first aperture 410 and into the second aperture 415 until the tube or pipe abuts the stop surface. Thus, the area light 400 can be supported by a pipe or tube.

As illustrated in FIG. 16, a strut 425 extends between the first end cap 405 and the second end cap 420. The strut 425 includes a second support feature 430 in the form of a triangular shaped aperture that extends through the strut 425. The aperture 430 includes a raised collar around the aperture's perimeter to enhance the strength of the aperture 430. A user can place the aperture 430 over a nail or other extended component to hang the light 400. The triangular shape serves to guide the nail into a desired corner to support the light 400 in a desired orientation.

FIG. 17 illustrates four additional features suitable for use in supporting the area light 400 during use. The strut 425 includes a recess or groove 435 that extends in a direction normal to the long axis of the light 400 and of the strut 425. The groove 435 is sixed to receive a wire, string, nail, and the like to support the light by the groove 435. Similar features in the form of grooves 445, 450, and 455 formed in the handle 440 of the light 400 operate in a manner similar to the groove 435. The first groove 455 is formed in the center of the handle 440 and is formed to receive a wire, string, nail, and the like to support the light by the groove 455. The remaining two grooves 445, 450 are formed in the corners of the handle and operate to hang the light from those grooves 445, 450 using a wire, string, nail, and the like as with the other grooves 435, 455. It should be noted that the grooves illustrated in FIG. 17 as well as the first support feature and the second support feature 430 could be applied to other constructions described herein as desired.

Thus, the invention provides a light that can be easily supported in multiple orientations to uniformly illuminate a work area or region. The light can use a power tool battery pack to power LEDs to provide the desired illumination. The light can also include a heat sink configured to effectively draw waste heat away from the LEDs.

In addition, the arrangement of the LEDs and the reflector in combination with the high-voltage (greater than about 18 volts) power source allows for a unique light output. Other lights such as halogen lights are able to produce a high intensity light. The arrangement of the device described herein allows an LED light to produce light having a greater intensity than a typical halogen light. In addition, LED lights often produce light that is not as high in quality as the light produced by a halogen light. The quality of light is measured using a Color Rendering Index (CRI) with a value of 100 being the best rating. The following table lists some values for the properties described above.

| | LUX Reading | | | | | | |
|---|---|---|---|---|---|---|---|
| | High | | | Low | | | |
| | 1M | 2M | 3M | 1M | 2M | 3M | CRI |
| LED Light | 1300 | 344 | 152 | 676 | 166 | 75 | 86 |
| 250 W Halogen | 1070 | 302 | 138 | — | — | — | 97.6 |

Thus, the LED light described herein can produce over 1000 Lumens of light at the high setting having a light intensity of at least 1200 Lux and more preferably at least 1300 Lux. In the low setting, the LED is capable of producing a light intensity at one meter of least 600 Lux with some test results exceeding 675 Lux. Similarly, the LED is able to emit light having a CRI value in excess of 80 with tests producing results as high as 86. It should be noted that the testing performed produced results that varied from the reported values by 10 percent. Thus, terms such as "about" should include a range of plus or minus 10 percent of the reported value.

Various features of the invention are set forth in the following claims.

We claim:

1. A work light, comprising:

a housing including a first end portion, a second end portion opposite the first end portion, and a center portion extending between the first end portion and the second end portion;

a battery receptacle located on the center portion of the housing and configured to receive a power tool battery pack having a voltage of at least 18 volts without disassembly of the housing;

an LED light source disposed in the center portion of the housing and powered by the power tool battery pack; and a reflector positioned adjacent the LED light source and arranged to cooperate with the LED light source to produce light having an intensity at a distance of one meter that is at least 1200 Lux.

2. The work light of claim 1, further comprising a switch movable between a low setting and a high setting, and wherein the LED light source is coupled to the switch to emit a first level of light when the switch is in the high setting and a second level of light when the switch is in the low setting.

3. The work light of claim 2, wherein the LED light source produces light having an intensity at a distance of one meter that is at least 1200 Lux when the switch is in the high setting and produces light having an intensity at a distance of one meter that is at least 600 Lux when the switch is in the low setting.

4. The work light of claim 1, wherein the LED light source is operable in response to a flow of current from the power tool battery pack to emit light having a color rendering index of at least 80.

5. The work light of claim 1, wherein the LED light source is operable to produce light having an intensity at a distance of one meter that is at least 1300 Lux.

6. The work light of claim 1, wherein the LED light source includes a plurality of LEDs each coupled to a heat sink.

7. The work light of claim 6, wherein the reflector includes a plurality of recesses arranged such that each of the LEDs is disposed adjacent one of the recesses.

8. The work light of claim 7, wherein each of the recesses is one of conical or pyramidal and includes a small end adjacent the respective LED and a large end opposite the LED through which light produced by the LED is emitted from the reflector.

9. The work light of claim 1, wherein the LED light source produces at least 1000 lumens of light when fully powered by the power tool battery pack.

10. A work light, comprising:

a housing including a first end portion, a second end portion opposite the first end portion, and a center portion extending between the first end portion and the second end portion, the first end portion and the second end portion being polygonal;

a battery receptacle located on the center portion of the housing and configured to receive a power tool battery pack having a voltage of at least 18 volts without disassembly of the housing;

an LED light source disposed in the center portion of the housing and powered by the battery pack, the LED light source operable in response to a flow of current from the power tool battery pack to emit light having a color rendering index of at least 80.

11. The work light of claim 10, further comprising a switch movable between a low setting and a high setting, and wherein the LED light source is coupled to the switch to emit a first level of light when the switch is in the high setting and a second level of light when the switch is in the low setting.

12. The work light of claim 11, wherein the LED light source produces light having an intensity at a distance of one meter that is at least 1200 Lux when the switch is in the high setting and produces light having an intensity at a distance of one meter that is at least 600 Lux when the switch is in the low setting.

13. The work light of claim 10, wherein the LED light source is operable to produce light having an intensity at a distance of one meter that is at least 1300 Lux.

14. The work light of claim 10, wherein the LED light source includes a plurality of LEDs each coupled to a heat sink.

15. The work light of claim 14, further comprising a reflector that includes a plurality of recesses arranged such that each of the LEDs is disposed adjacent one of the recesses.

16. The work light of claim 15, wherein each of the recesses is one of conical or pyramidal and includes a small end adjacent the respective LED and a large end opposite the LED through which light produced by the LED is emitted from the reflector.

17. The work light of claim 10, wherein the LED light source produces at least 1000 lumens of light when fully powered by the power tool battery pack.

18. A work light, comprising:

a housing including a first end portion, a second end portion opposite the first end portion, and a center portion extending between the first end portion and the second end portion, the first end portion and the second end portion cooperating to define a longitudinal axis extending therebetween;

a battery receptacle located on the housing and configured to receive a power tool battery pack having a voltage of at least 18 volts;

an LED light source including a plurality of individual LEDs disposed in the center portion of the housing and powered by the power tool battery pack, the LEDs arranged to emit light from the center portion of the housing in a direction normal to the longitudinal axis;

a switch operable between a low setting and a high setting; and a reflector positioned adjacent the LED light source and arranged to cooperate with the LED light source to produce light having an intensity at a distance of one meter that is at least 1200 Lux when the switch is in the high setting and is at least 600 Lux when the switch is in the low setting, the reflector arranged to reflect light from the center portion of the housing in a direction normal to the longitudinal axis.

19. The work light of claim 18, wherein the battery receptacle is positioned in the center portion.

20. The work light of claim 18, wherein the LED light source is operable in response to a flow of current from the power tool battery pack to emit light having a color rendering index of at least 80.

21. The work light of claim 18, wherein the LED light source is operable to produce light having an intensity at a distance of one meter that is at least 1300 Lux when the switch is in the high setting.

22. The work light of claim 18, wherein the reflector includes a plurality of recesses arranged such that each of the LEDs is disposed adjacent one of the recesses.

23. The work light of claim 22, wherein each of the recesses is one of conical or pyramidal and includes a small end adjacent the respective LED and a large end opposite the LED through which light produced by the LED is emitted from the reflector.

* * * * *